US010881973B2

(12) United States Patent
Swasey et al.

(10) Patent No.: US 10,881,973 B2
(45) Date of Patent: Jan. 5, 2021

(54) PIVOT COASTER SYSTEMS, APPARATUSES, AND METHODS

(71) Applicant: S&S WORLDWIDE, INC., Logan, UT (US)

(72) Inventors: Merin Jay Swasey, North Logan, UT (US); Michael Dean Worley, Wellsville, UT (US); Jason Ross Parrish, Nibley, UT (US); Nyles Todd Snyder, Nlbley, UT (US); Quin Reeding Checketts, Sumiyoshihonmachi (JP); Michael Steven Heare, Logan, UT (US)

(73) Assignee: S&S WORLDWIDE, INC., Logan, UT (US)

( * ) Notice: Subject to any disclaimer, the term of this patent is extended or adjusted under 35 U.S.C. 154(b) by 431 days.

(21) Appl. No.: 15/960,124

(22) Filed: Apr. 23, 2018

(65) Prior Publication Data

US 2019/0321736 A1 Oct. 24, 2019

(51) Int. Cl.

| | |
|---|---|
| ***A63G 7/00*** | (2006.01) |
| ***A63G 21/08*** | (2006.01) |
| ***A63G 27/02*** | (2006.01) |

(52) U.S. Cl.

CPC ..... *A63G 21/08* (2013.01); *A63G 7/00* (2013.01); *A63G 27/02* (2013.01)

(58) Field of Classification Search

CPC ..... A63G 7/00; A63G 7/08; A63G 7/02

See application file for complete search history.

(56) References Cited

U.S. PATENT DOCUMENTS

| | | | | |
|---|---|---|---|---|
| 4,170,943 | A | 10/1979 | Ackrekar et al. | |
| 6,227,121 | B1 * | 5/2001 | Mares | A63G 1/00 104/53 |
| 7,677,179 | B2 | 3/2010 | Payne | |
| 7,918,740 | B2 * | 4/2011 | Kitchen | A63G 1/34 472/36 |
| 8,057,317 | B2 * | 11/2011 | Roodenburg | A63G 31/16 472/43 |
| 8,393,275 | B2 | 3/2013 | Jacobi et al. | |
| 9,751,022 | B1 | 9/2017 | Fram | |

(Continued)

FOREIGN PATENT DOCUMENTS

| | | |
|---|---|---|
| DE | 202010000403 | 9/2011 |
| EP | 1332779 | 8/2003 |

(Continued)

OTHER PUBLICATIONS

Wikipedia, "Seven Dwarfs Mine Train," Revised Apr. 21, 2018; URL: https://en.wikipedia.org/wiki/Seven_Dwarfs_Mine_Train.

(Continued)

*Primary Examiner* — Scott A Browne
(74) *Attorney, Agent, or Firm* — Stoel Rives LLP

(57) ABSTRACT

An apparatus for providing lateral movement on a roller coaster includes a main chassis, a passenger chassis, and a hub. The main chassis is configured to ride on a track. The passenger chassis is rotatably supported on the main chassis via the hub. The hub and main chassis are behind the passenger chassis. The hub allows the passenger chassis to perform a full lateral rotation relative to the main chassis.

28 Claims, 8 Drawing Sheets

(56) References Cited

U.S. PATENT DOCUMENTS

| | | | | |
|---|---|---|---|---|
| 2007/0010336 | A1* | 1/2007 | Kitchen | A63G 7/00 472/43 |
| 2007/0265103 | A1 | 11/2007 | Roodenburg et al. | |
| 2012/0149480 | A1 | 6/2012 | Crawford et al. | |
| 2015/0283468 | A1* | 10/2015 | Snyder | A63G 27/02 104/76 |
| 2018/0290062 | A1* | 10/2018 | Hu | A63G 31/16 |

FOREIGN PATENT DOCUMENTS

| | | | | |
|---|---|---|---|---|
| EP | 2873448 | | 5/2015 | |
| FR | 3000407 | | 7/2014 | |
| WO | 200195989 | | 12/2001 | |
| WO | 2003082421 | | 10/2003 | |
| WO | WO-2019134034 | A1 * | 7/2019 | A63G 21/20 |

OTHER PUBLICATIONS 19167695.6, Extended European Search Report, dated Sep. 19, 2019, 9 pages.

* cited by examiner

PIVOT COASTER SYSTEMS, APPARATUSES, AND METHODS

RELATED APPLICATION

U.S. Pat. No. 9,675,893 granted Jun. 13, 2017 and U.S. Pat. No. 9,144,745 granted Sep. 9, 2015 are incorporated by reference herein in their entirety.

TECHNICAL FIELD

The present disclosure relates to amusement rides and more particularly relates to an amusement ride vehicle capable of lateral motion relative to the track.

BRIEF DESCRIPTION OF THE DRAWINGS

The written disclosure herein describes illustrative embodiments that are non-limiting and non-exhaustive. Reference is made to certain illustrative embodiments that are depicted in the figures.

DETAILED DESCRIPTION

Roller coasters and other amusement rides often ride on tracks. With roller coasters, a vehicle carrying one or more passengers may be raised along a track to a high point where the vehicle can be released to roll down the track to gain speed and momentum for the amusement ride. A variety of twists, turns, and loops may be used to enhance the experience for the passengers.

The present application discloses systems, apparatuses, and methods for adding lateral motion to passenger seats on roller coasters and other amusement rides. In one embodiment, a hub rotatably couples a support structure that rides on the track to the rear of a passenger chassis that carries one or more passengers. The hub may provide for spin control, including inducing and inhibiting lateral rotational motion of a passenger chassis.

Figure 1:
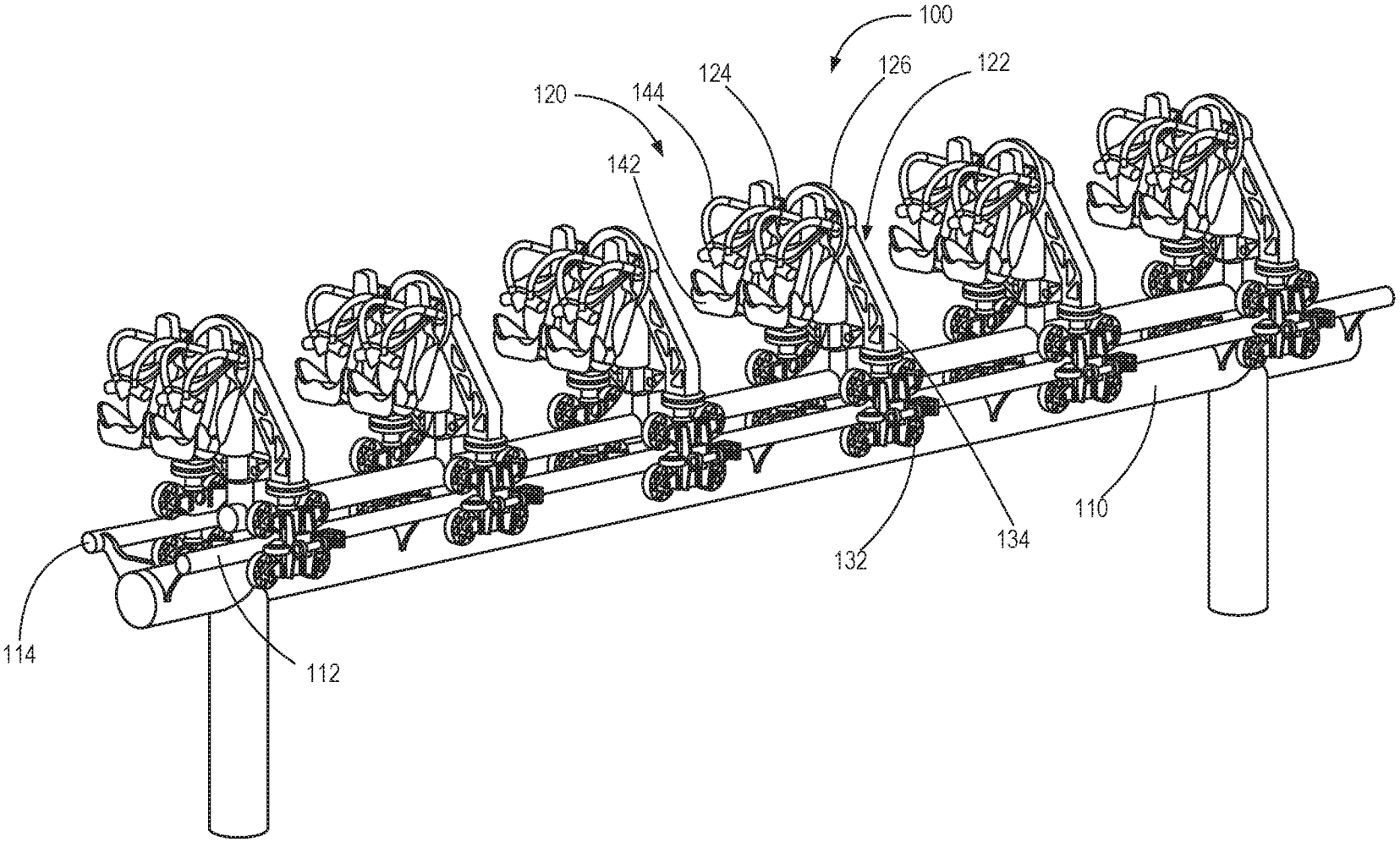
FIG. 1 illustrates a perspective view of a pivoting amusement ride system in a vertical orientation, according to one embodiment.
Figure 2:
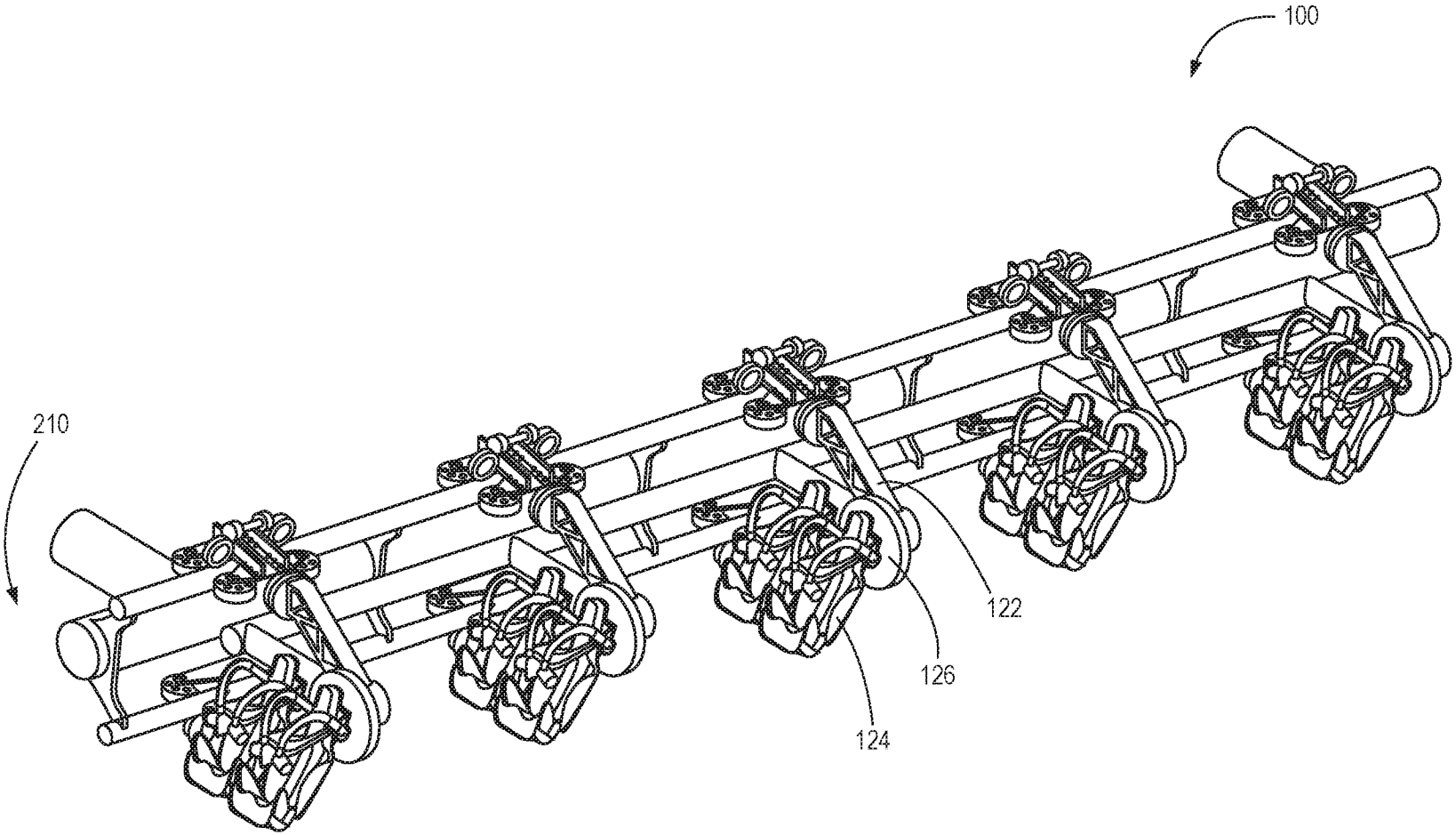
FIG. 2 illustrates a perspective view of the pivoting amusement ride system of FIG. 1 in a horizontal orientation, according to one embodiment.
Figure 3:
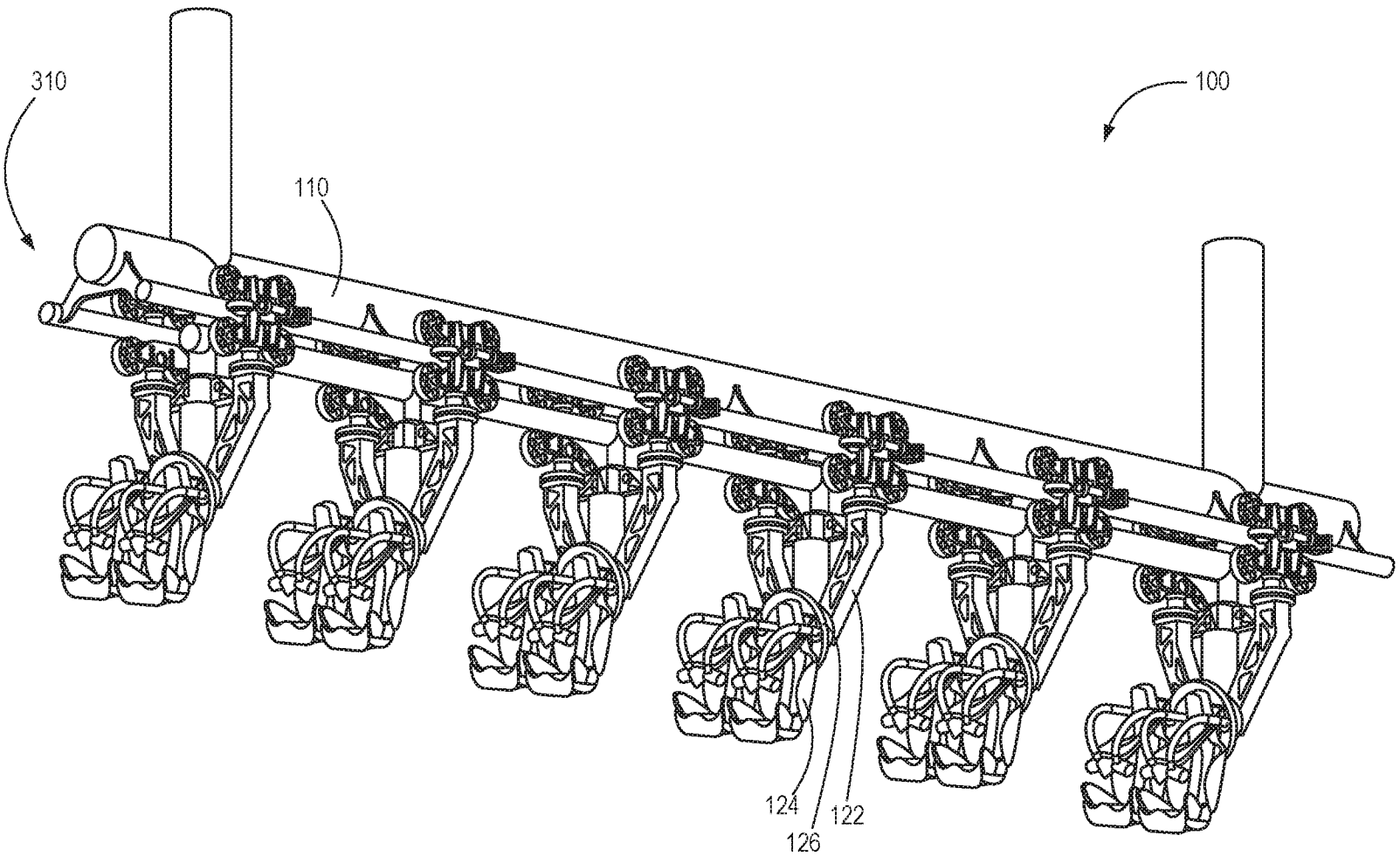
FIG. 3 illustrates a perspective view of the pivoting amusement ride system of FIG. 1 in an inverted orientation, according to one embodiment.

FIGS. 1-3 illustrate various orientations of a pivoting amusement ride system 100. As shown, the rotatability of a passenger chassis 124 can cause the passenger chassis 124 to change orientation relative to a track 110. For example, as shown, the passenger chassis 124 is able to rotate to maintain a vertical sitting position as the track 110 changes an angle or orientation of a main chassis 122. The passenger chassis 124 pivots around a single axis that is approximately aligned with the direction of travel 110 such that the passenger chassis 124 rotates laterally in relation to the track or direction of travel 110. The lateral rotation of the passenger chassis 124 adds additional dimension to a roller coaster and adds a dynamic effect to a passenger experience.

FIG. 1 illustrates a perspective view of the pivoting amusement ride system 100 in a vertical orientation, according to one embodiment. The pivoting amusement ride system 100 may comprise the track 110 and an amusement ride vehicle 120.

The track 110 supports and guides the amusement ride vehicle 120. In FIG. 1, the track 110 includes rails 112 and 114 positioned on a horizontal plane. While the illustrated embodiment comprises two rails, fewer or more rails may be used. For example, in some embodiments the rails 112 and 114 may support the amusement ride vehicle 120 in an upright or vertical orientation as shown. In a vertical orientation, the amusement ride vehicle 120 is positioned above the track 110.

The amusement ride vehicle 120 comprises the main chassis 122, the passenger chassis 124, and a hub 126. The amusement ride vehicle 120 may be configured to ride on the track 110 and carry passengers in the passenger chassis 124. As illustrated, in some embodiments, a plurality of amusement ride vehicles 120 may be coupled together to form a train of vehicles.

The main chassis 122 may include a plurality of wheels 132 that engage the track 110 or rail of a guide system. The wheels 132 may engage a rail while allowing the main chassis 122 to move in relation to the track 110 with low friction. The main chassis 122 may also include the frame 134 projecting away from the track 110. The frame 134 has a proximal portion and a distal portion, wherein the distal portion is further from the track 110 than the proximal portion. The frame 134 couples to the wheels 132 and supports the passenger chassis 124 at a distance from the track 110.

The passenger chassis 124 is a chassis for supporting one or more passengers. In FIG. 1, each passenger chassis 124 is configured to support two passenger seats 142. In varying embodiments, the passenger chassis 124 may include the one or more seats 142, harnesses 144, belts, or other members for securing a passenger to or in the passenger chassis 124.

In one embodiment, the passenger chassis 124 and main chassis 122 provide support of a passenger while allowing the passenger to be free from surrounding obstructions. For example, a passenger sitting on the passenger chassis 124 may be substantially free from structures in front, above, and/or to the side of the passenger. In other embodiments, other configurations for the passenger chassis 124 may provide a support for the passenger without obstructions in substantially every direction. In the illustrated embodiment, the main chassis 122 is positioned behind the passenger chassis 124 to provide an unobstructed view to passengers in the passenger seats 142.

The hub 126 rotatably couples the passenger chassis 124 to the distal portion of the main chassis 122 such that the passenger chassis 124 is supported away from the track 110. The hub 126 couples the passenger chassis 124 and the main chassis 122 at a single rotatable connection point. Because the hub 126 allows the passenger chassis 124 to rotate and the main chassis 122 couples to a track, rail, or other guide system, the passenger chassis 124 may extend above, laterally to, or below the track, rail, or guide system. This may give a rider different experiences as the orientation changes. The passenger chassis 124 may be mounted to face forward or rearward with respect to the vehicle direction of travel. In one embodiment, the passenger chassis 124 may face forward while another passenger chassis 124 may face rearward with respect to the vehicle direction of travel.

Furthermore, with little structure surrounding a passenger, the passenger may be exposed to the surroundings in a manner that provides for a more exhilarating ride. The frame 134 may be positioned to provide unobstructed views to passengers in the passenger seats 142. For example, in the illustrated embodiment, the hub 126 and frame 134 are entirely behind the one or more passenger seats 142.

The hub 126 facilitates lateral rotation of the passenger chassis 124 relative to the main chassis 122. Lateral rotation refers to a direction approximately orthogonal to the direction of travel of the amusement ride vehicle 120 along the track 110. In the illustrated embodiment, the axis of the lateral rotation is positioned in the center of the passenger seats 142. In some embodiments, the hub 126 allows the passenger chassis 124 to perform a full lateral rotation relative to the main chassis 122. The hub 126 may include ball bearings or other low friction joint that allows the relative rotation of the passenger chassis 124 and the main chassis 122.

The hub 126 may control the spin speed and spin radius. For example, the hub 126 may prevent the passenger chassis 124 at certain points along the track 110 from performing a full rotation. The hub 126 may dampen rotation of the passenger chassis 124 with respect to the main chassis 122. For example, the hub 126 may use one or more magnets to generate eddy currents that may be used to dampen the rotation of the passenger chassis 124. In some embodiments, the hub may use friction brakes, torsional oil damper, or a fluid damper method.

In some embodiments, the spin speed and spin radius may be controlled by a passenger though a physical mechanism on the passenger chassis 124. For example, a rider may adjust a handle to reduce spin speed or radius. In some embodiments, the user may select a desired intensity level and the spin speed or radius may automatically adjust. In some embodiments, the spin speed and radius may be adjusted while the passenger chassis 124 is in motion.

The spin of the passenger chassis 124 may be controlled with a motor, a track element, or some other motive force. For example, the track element may cause an uncontrolled passenger chassis to swing laterally to a 90 degree position. However, if a user selects to a ride with a reduced spin radius, a motor may apply a force to limit the lateral movement to less than 90 degrees.

In some embodiments, a damping rate of the lateral rotation of the passenger chassis 124 may depend on a rotational position of the passenger seats 142. For example, the damping rate may increase as the passenger seats 142 become more horizontal or passes horizontal.

In one embodiment, the passenger chassis 124 may be weighted to return to a default position. For example, the passenger chassis 124 may be allowed to rotate with respect to the main chassis 122 and return to a default position where passengers are oriented in a vertical sitting position, or other desirable position. In one embodiment, the passenger chassis 124 may be weighted to return to a default position while taking the weight of any passengers into account. For example, the passenger chassis 124 may be weighted to offset imbalances that may occur when carrying passengers.

FIG. 2 illustrates a perspective view of the pivoting amusement ride system 100 of FIG. 1 in a horizontal orientation, according to one embodiment. As shown, a vertical track element 210 directs the main chassis 122 to extend horizontally away from the vertical track element 210. The passenger chassis 124 may be weighted to rotate to a vertical position via the hub 126. Thus, the passenger chassis 124 extends to the side of the track 110 in a vertical position.

In the illustrated embodiment, the vertical track element 210 comprises two rails with one rail positioned above the other rail. The vertical track element 210 causes a passenger to ride to the side of the track 110 introducing a different sensation than when in the vertical orientation as shown in FIG. 1. The passenger chassis 124 rotates via the hub 126 to return to a vertical sitting position as the track 110 changes an orientation of the main chassis 122. The horizontal orientation may be used for loading and unloading or introducing additional movement during a turn.

FIG. 3 illustrates a perspective view of the pivoting amusement ride system 100 of FIG. 1 in an inverted orientation, according to one embodiment. As shown, an inverted track element 310 causes the main chassis 122 to hang down from the inverted track element 310. The passenger chassis 124 is weighted to rotate to a vertical position via the hub 126. Thus, the passenger chassis 124 hangs below the track 110 in a vertical position.

In the illustrated embodiment, the inverted track element 310 comprises two horizontal rails with support structures above the rails. The inverted track element 310 causes a passenger to ride below the track 110 introducing a different sensation than when in the vertical orientation as shown in FIG. 1, and the horizontal orientation of FIG. 2. The passenger chassis 124 rotates via the hub 126 to return to a vertical sitting position as the track 110 changes an orientation of the main chassis 122. The inverted orientation may be used to introduce a free hanging sensation for passengers.

The different orientations shown in FIGS. 1-3 may be used to add additional dimension to a roller coaster design. For example, a first orientation may be used for loading and a second orientation introduced by a different track element. For instance, a roller coaster may load passengers in a horizontal orientation on the vertical track element 210, and then as the amusement ride vehicle 120 moves along the track 110 introduce the inverted track element 310 to cause passengers to hang below the track 110. Additionally, varying the orientation of the pivoting amusement ride system 100 may add a dynamic effect to a passenger experience. In some embodiments, the track 110 may induce or inhibit spinning of the passenger chassis 124 based on a speed of the vehicle at a specific location on the track 110.

Figure 4:
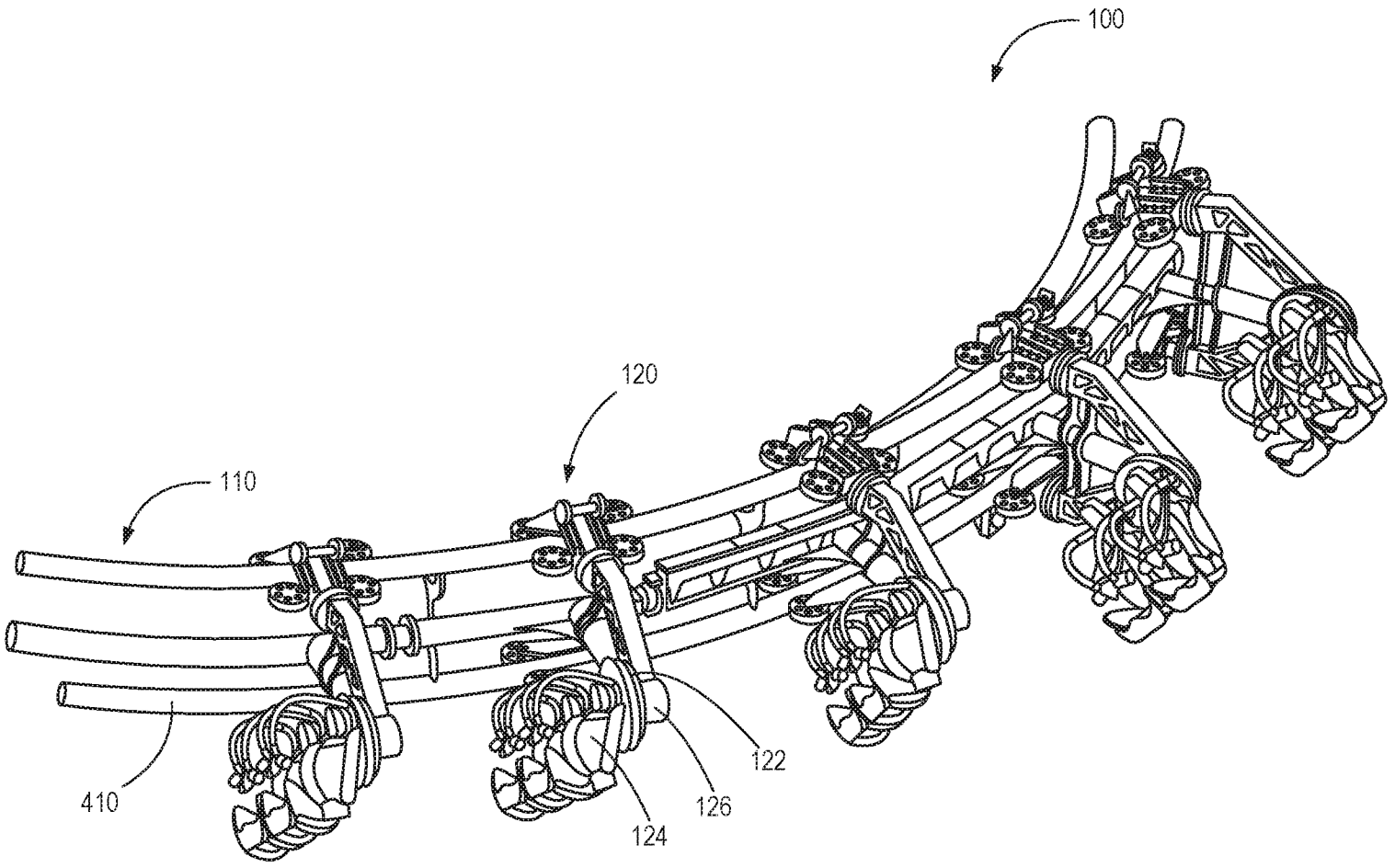
FIG. 4 illustrates a perspective view of the pivoting amusement ride system of FIG. 1 facilitating lateral movement of a passenger chassis as amusement ride vehicles move along a track, according to one embodiment.

FIG. 4 illustrates a perspective view of the pivoting amusement ride system 100 of FIG. 1 facilitating lateral movement of the passenger chassis 124 as the amusement ride vehicles 120 moves along the track 110, according to one embodiment. Different track elements may cause different types of motion as the amusement ride vehicle 120 moves along the track 110. For example, FIGS. 1-3 illustrate three different orientations that the passenger chassis 124 may be in relative to the track 110.

In addition to the various orientations, track elements may cause the passenger chassis 124 to rotate or swing. For example, as illustrated in FIG. 4 the embodiment shows the amusement ride vehicle 120 on a curved track element 410.

The curved track element 410 introduces a centrifugal force on the passenger chassis 124 as the amusement ride vehicle 120 moves along the track 110. The hub 126 may allow the passenger chassis 124 to laterally rotate due to the centrifugal force. As the curved track element 410 ends, the passenger chassis 124 may rotate via the hub 126 to return to a vertical sitting position. In some embodiments, the hub 126 allows the passenger chassis 124 to perform a full lateral rotation relative to the main chassis 122.

The rotation may be about an axis in a center of the one or more passenger seats 142. The axis of rotation approximately aligned with the direction of travel and track 110 allows the passenger chassis 124 to rotate laterally relative to the track 110. The lateral motion (seat rotation) may be dampened to control the spin rate and or spin radius of the passenger chassis 124. In some embodiments, the hub 126 dampens rotation of the passenger chassis 124 with respect to the main chassis 122. The hub 126 may use eddy currents to control the spin rate of the passenger chassis 124.

Figure 5B:
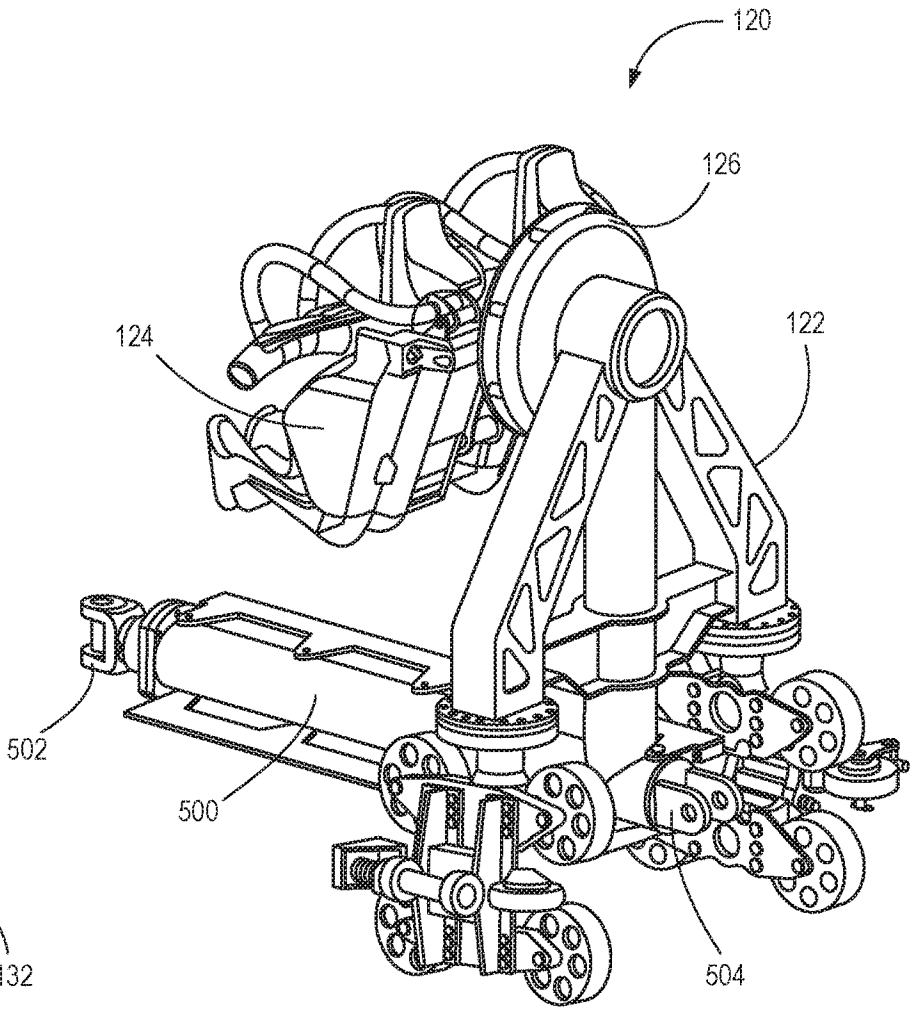
FIG. 5B illustrates a rear perspective view of a pivoting amusement ride vehicle, according to one embodiment.
Figure 5A:
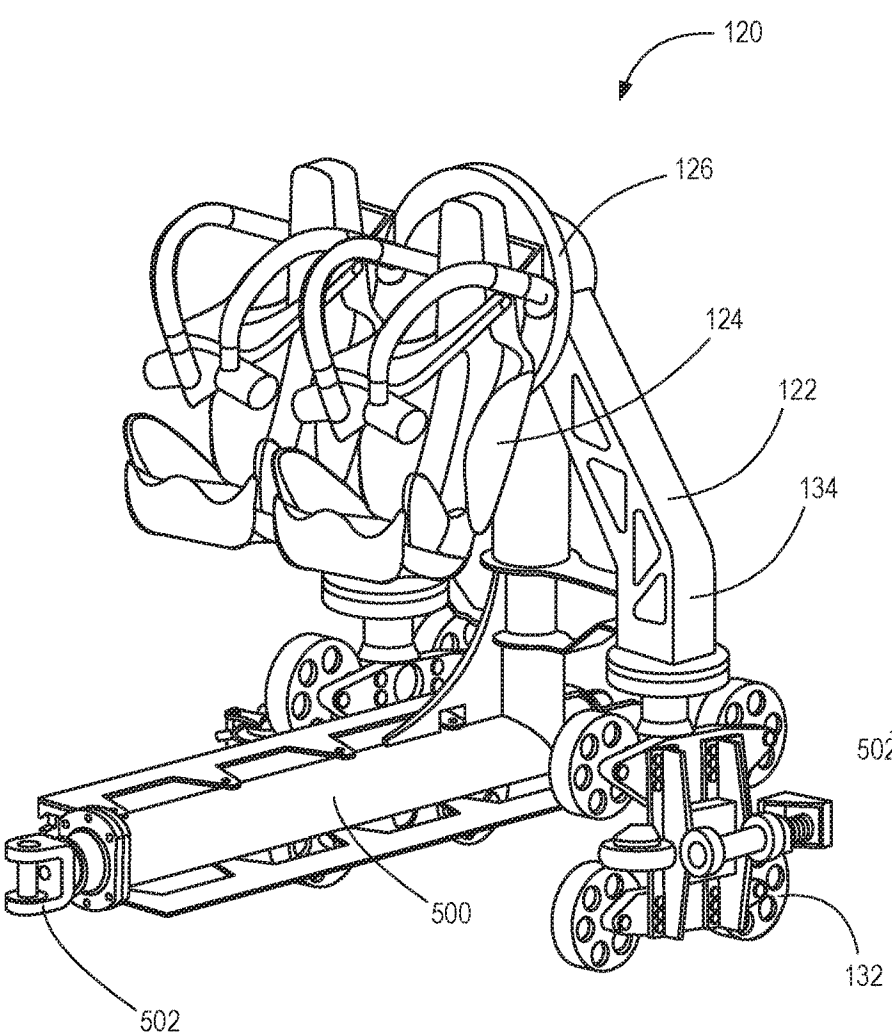
FIG. 5A illustrates a front perspective view of a pivoting amusement ride vehicle, according to one embodiment.

FIGS. 5A-5B illustrate one of the pivoting amusement ride vehicles 120 of FIG. 1. FIG. 5A illustrates a front perspective view of an amusement ride vehicle 120, according to one embodiment. FIG. 5B illustrates a rear perspective view of the amusement ride vehicle 120, according to one embodiment. The amusement ride vehicle 120 comprises the main chassis 122, the passenger chassis 124, and a coupler 500.

The main chassis 122 may include a plurality of the wheels 132 that engage the track 110 or rail of a guide system. The wheels 132 may engage a rail while allowing the main chassis 122 to move in relation to the track 110 with low friction. The main chassis 122 may also include the frame 134 projecting away from the track 110. The frame 134 has a proximal portion and a distal portion, wherein the distal portion is further from the track 110 than the proximal portion. The frame 134 couples to the wheels 132 and supports the passenger chassis 124 at a distance from the track 110. The passenger chassis 124 supports one or more passengers and is coupled to the distal end of the main chassis 122 via the hub 126.

The hub 126 rotates to allow lateral movement of the passenger chassis 124. For example, in some movements, the passenger chassis 124 may rotate 360 degrees. The rotation may be dampened by the hub 126. For example, a magnetic hub may use eddy currents to resist rotation. In some embodiments, the hub 126 may increase the speed of rotation.

In one embodiment, the hub 126 includes fins with a conductive material that operates to resist movement with respect to a magnetic field of the hub 126. In one embodiment, the fins and hub 126 may oppose rotation with respect to each other. For example, due to Lenz's law, the conductivity of the fins and the changing direction and/or magnitude of the magnetic field in the hub 126 creates a force to oppose relative movement. As will be understood by one of skill in the art, similar principles are used in eddy current brakes or inductive brakes. For example, the hub 126 can be described as operating as eddy current breaks to slow relative rotation of the passenger chassis 124.

The coupler 500 may connect the amusement ride vehicle 120 to other amusement ride vehicles 120. The coupler 500 may include a front link 502 and a rear link 504. The front link 502 may be configured to be relieved by the rear link 504 of another amusement ride vehicle 120. In some embodiments, the coupler 500 may allow pivoting between the amusement ride vehicles 120.

Figure 6:
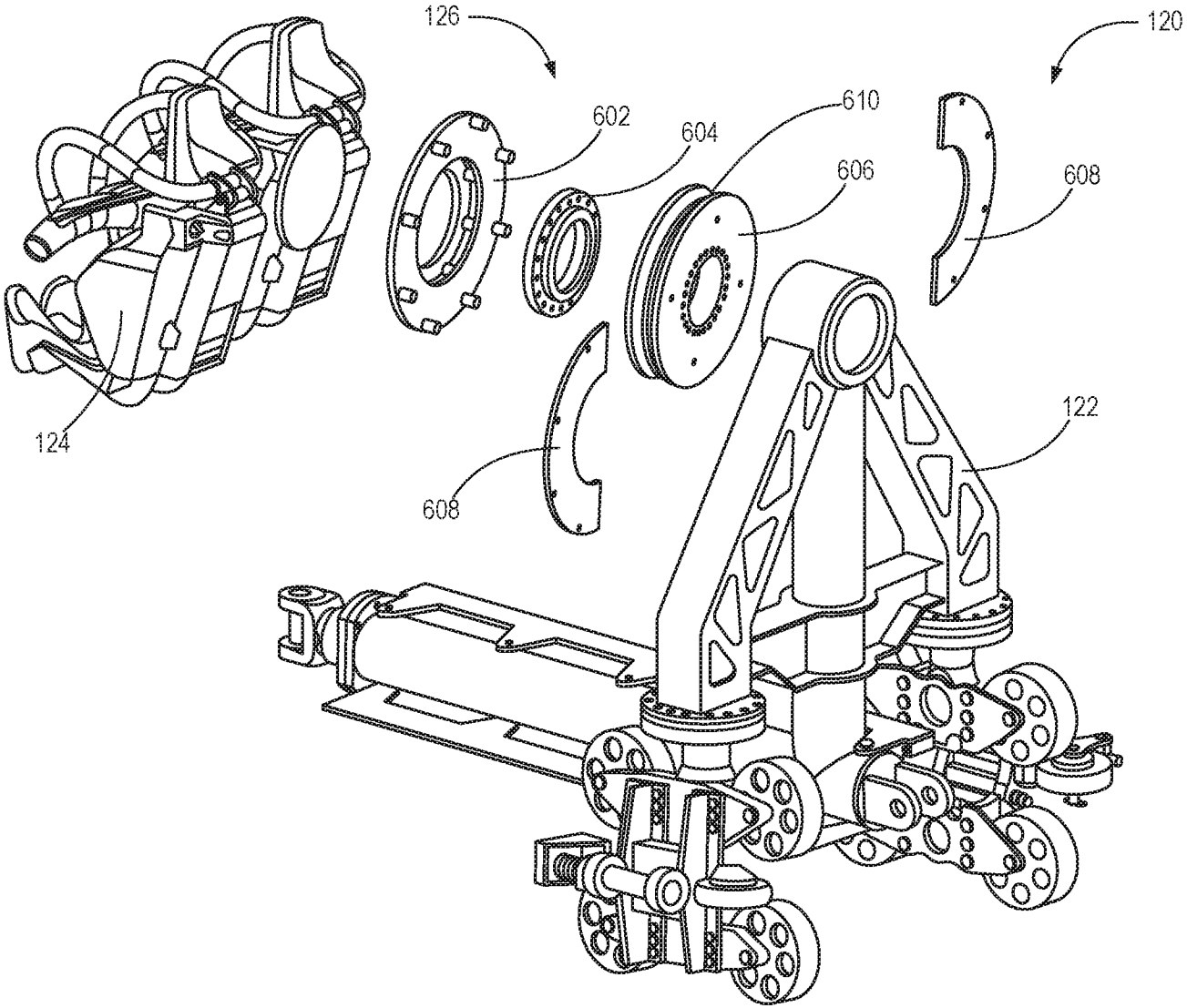
FIG. 6 illustrates an exploded view of the pivoting amusement ride vehicle of FIGS. 5A-5B, according to one embodiment.

FIG. 6 illustrates an exploded view of the amusement ride vehicle 120 of FIGS. 5A-5B, according to one embodiment. As shown, the hub 126 may couple the passenger chassis 124 to the main chassis 122. Components of the hub 126 (e.g., 602-608) may laterally rotate the passenger chassis 124 relative to the main chassis 122.

The passenger chassis 124 may include the one or more passenger seats 142. The number of the passenger seats 142 may vary based on an amount of clearance for the passenger chassis 124 to rotate. For example, if the main chassis 122 supports the passenger chassis 124 at a height equal to more than two passenger seats 142, there may be four passenger seats 142 as the rotational radius will be two passenger seats 142.

In one embodiment, the hub 126 includes a damping magnet 606 that creates a magnetic field that can be used to control rotation of the passenger chassis 124. In one embodiment, the hub 126 allows for spin control of the passenger chassis 124. For example, the hub 126 may allow the passenger chassis 124 to rotate with respect to the main chassis 122 and spin or rotation of the passenger chassis 124 may be controlled by interacting with a magnetic field of the hub 126.

The hub 126 may comprise a magnetic fin support bracket assembly 602. The magnetic fin support bracket assembly 602 may mount directly to the passenger chassis 124. The location of the magnetic fin support bracket assembly 602 determines where the axis of rotation for the passenger chassis 124 will be. The magnetic fin support bracket assembly 602 provides an interface to couple to the passenger chassis 124. For example, the passenger chassis 124 may be coupled to the hub 126 with bolts or other fasteners that couple the passenger chassis 124 to the magnetic fin support bracket assembly 602. Additionally, the magnetic fin support bracket assembly 602 may couple to and support damping fins 608. The magnetic fin support bracket assembly 602 may transfer the damping load from the damping fins 608 to the passenger chassis 124 to prevent the passenger chassis 124 from rotating freely or providing a controlled spin rate for the rotation.

A slewing bearing 604 allows the passenger chassis 124 to rotate with respect to the main chassis 122. The slewing bearing 604 may have one side mounted to the passenger chassis 124 and the other side mounted to the main chassis 122. The slewing bearing 604 may include a first ring that may be attached to the main chassis 122 and a second ring that may be fixed with respect to the spin hub 110. The first ring and second ring ride on one or more bearings relative to each other. For example, the first ring of the slewing bearing 604 may be fixed to the main chassis 122, while the second ring allows the passenger chassis 124 to rotate with respect to the first ring and/or main chassis 122. The slewing bearing 604 may include any type of slewing bearing 604 and may be configured to support the load of the passenger chassis 124 and any passengers. The slewing bearing 604 is only one embodiment of a joint or bearing that may be used to allow the hub 126 and/or passenger chassis 124 to rotate with respect to the main chassis 122.

The damping magnet 606 creates a magnetic field that may be used to control rotation or spinning of the spin hub 110. The damping magnet 606 may be mounted to the main chassis 122. In the illustrated embodiment, the damping magnet 606 is round. However, the damping magnet 606 could also be a single rectangular block or other shape. The damping magnet 606 may comprise one or more magnets forming a magnetic array.

The damping magnet 606 may include two or more magnets on opposite sides of a gap 610. The magnets of the damping magnet 606 may be arranged to create a magnetic field within the gap 610. For example, magnets on opposite sides of the gap 610 may be arranged to provide magnetic fields such that the field within the gap 610 is maximized. Similarly, the magnets of the damping magnet 606 may be arranged to minimize the creation of a magnetic field outside of the damping magnet 606. In one embodiment, the damping magnet 606 includes a guide plate, which guides magnetic fields and/or contains the magnetic field to a desired location, such as within the gap 610. The magnets of the damping magnet 606 may include permanent magnets or may include electromagnets, which can be controlled to provide variations in the magnitude and/or direction of the magnetic field.

The magnets in the damping magnet 606 may be arranged to create a varying magnetic field within the gap 610. For example, the magnets may be arranged to create an alternating magnetic field within the gap 610, such that the magnetic field at a given position within the gap 610 will change as the hub 126 rotates.

Although FIG. 2 only illustrates a single gap 610 on the hub 126, more than one gaps 610 may be included in some embodiments. For example, multiple magnetic arrays may form two or more gaps 610 such that more than one fin may extend into a gap 610 from the same side of the hub 126. In one embodiment, a greater number of gaps 610 can increase the amount of force that can be imparted towards inducing or inhibiting rotation of the passenger chassis 124.

In yet another embodiment, the damping magnet 606 may not include opposing magnets which form a gap 610. For example, the damping magnet 606 may include an array of magnets that create a magnetic field to a side of the damping magnet 606 but not within a gap 610. For example, a fin in proximity to a magnet or magnetic array may induce or inhibit rotation by extending to a magnetic field of the damping magnet 606. In one embodiment, the amount of force created between the fins and the damping magnet 606 may be varied by positioning the fin at a desired distance from the magnetic array. For example, a fin that is positioned closer to the damping magnet 606 may result in a greater force while a fin that is positioned further away may result in a reduced amount of force.

The damping fins 608 may be rigidly attached to the passenger chassis 124 through the magnetic fin support bracket assembly 602. The damping fins 608 extend into the magnetic field of the damping magnet 606. The damping fins 608 are configured to dampen rotation of the passenger chassis 124 with respect to the main chassis 122.

The damping fins 608 are configured to interact with a magnetic field of the hub 126 to provide control of rotation of the passenger chassis 124. In one embodiment, the damping fins 608 include a conductive material that operates to resist movement of the damping fins 608 with respect to the magnetic field of the damping magnet 606. In one embodiment, the damping fins 608 and damping magnet 606 may oppose rotation with respect to each other. For example, due to Lenz's law, the conductivity of the fins and the changing direction and/or magnitude of the magnetic field in the gap 610 creates a force to oppose relative movement. As will be understood by one of skill in the art, similar principles are used in eddy current brakes or inductive brakes. For example, the damping fins 608 can be described as operating as eddy current breaks to slow relative rotation of the damping fins 608.

In some embodiments, the damping fins 608 are installed into the gap 610. As the passenger chassis 124 rotates, the rotating damping fins 608 create an eddy current that provides the passenger chassis 124 with a controlled spin rate. Thus, the hub 126 dampens the rotation of the passenger chassis 124.

In one embodiment, the damping fins 608 are fixed relative to the passenger chassis 124 and extend into the gap 610 of the damping magnet 606 to interact with the magnetic field in the gap 610. Because the damping fins 608 oppose relative movement of the hub 126, the rotation of the passenger chassis 124 with respect to the main chassis 122 is inhibited or dampened. For example, the damping fins 608 may interact with the magnetic field in the gap 610 to cause rotation of the passenger chassis 124 to slow over time, or to reduce how quickly the passenger chassis 124 will turn with respect to the main chassis 122. In one embodiment, if the main chassis 122 is rotating (e.g. turning to move up a slope, turning to move down a slope, or traveling on a loop portion of the track 110) the damping fins 608 may interact with the magnetic field to provide a force inducing the passenger chassis 124 to rotate with the main chassis 122.

The amount of force created by the hub 126 to control rotation may vary based on a variety of factors. For example, a magnitude of a magnetic field in the gap 610, a magnitude of the change of the magnetic field per unit distance, an amount of area within the gap 610 occupied by the fins, conductivity of the fins, a thickness of the fins, relative speed between the damping fins 608 and the damping magnets 606, and the like all may affect the amount of force created by the hub 126. For instance, additional fins may be added or the material of the damping fins 608 may be altered to change the effective damping.

Figure 7:
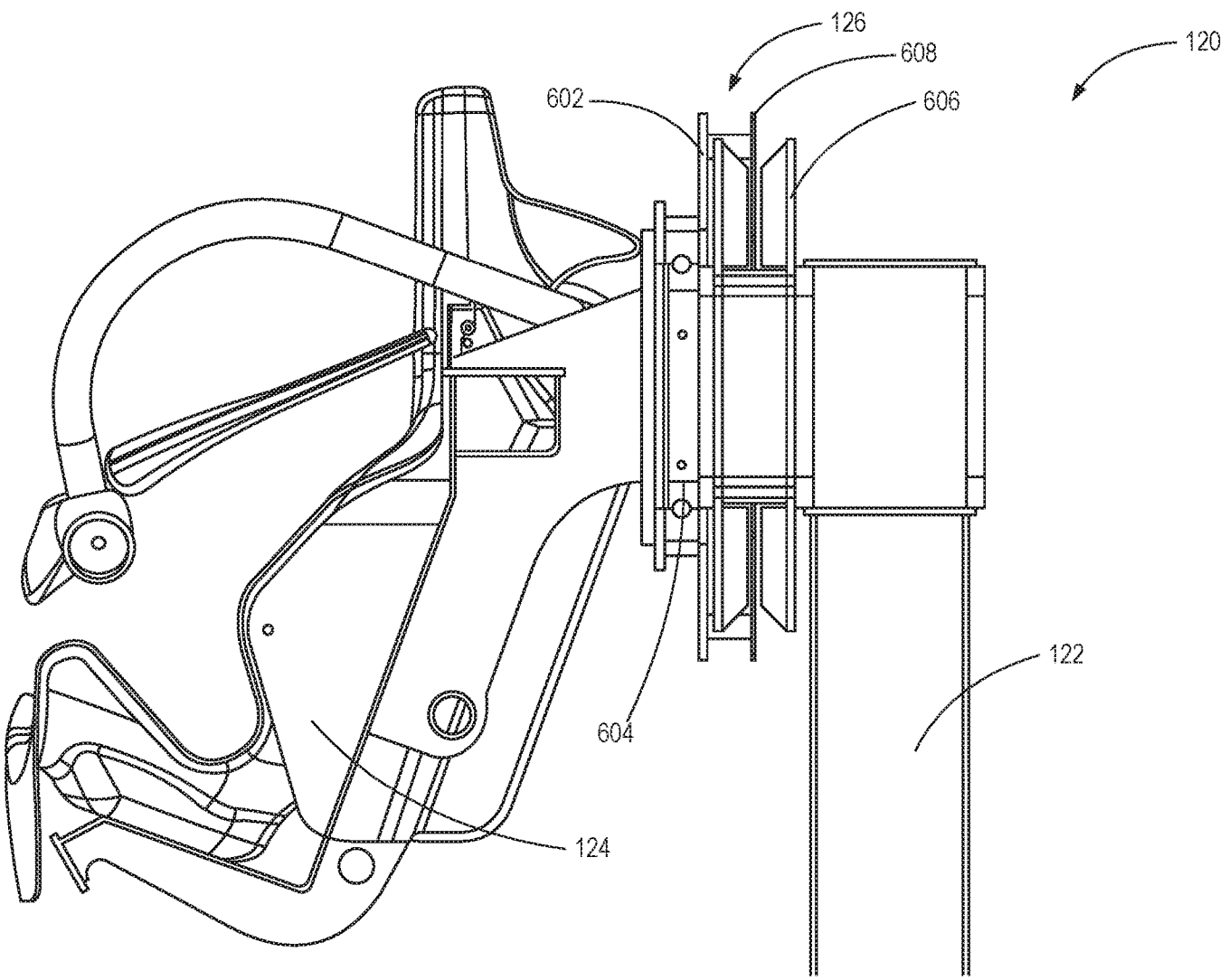
FIG. 7 illustrates a side view of the pivoting amusement ride vehicle of FIGS. 5A-5B, according to one embodiment.

FIG. 7 illustrates a side view of the pivoting amusement ride vehicle 120 of FIGS. 5A-5B, according to one embodiment. As shown, the passenger chassis 124 may be rotatably coupled to the main chassis 122 via the hub 126. The hub 126 includes a slewing bearing 604, a damping magnet 606, and a magnetic fin support bracket assembly 602. In one embodiment, the hub 126 allows for spin control of the passenger chassis 124.

For example, the hub 126 may allow the passenger chassis 124 to rotate laterally with respect to the main chassis 122 and spin or rotation of the passenger chassis 124 may be controlled by interacting with a magnetic field of the hub 126. The slewing bearing 604 may provide a low friction interface between the passenger chassis 124 and the main chassis 122. The magnetic fin support bracket assembly 602 may couple to the passenger chassis 124 and the damping fins 608. The damping fins 608 may extend into a gap of the damping magnet 606 to interact with the magnetic field of the damping magnet 606. The magnetic fin support bracket assembly 602, damping magnet 606, and slewing bearing 604 may be coupled together using bolts.

Figure 8:
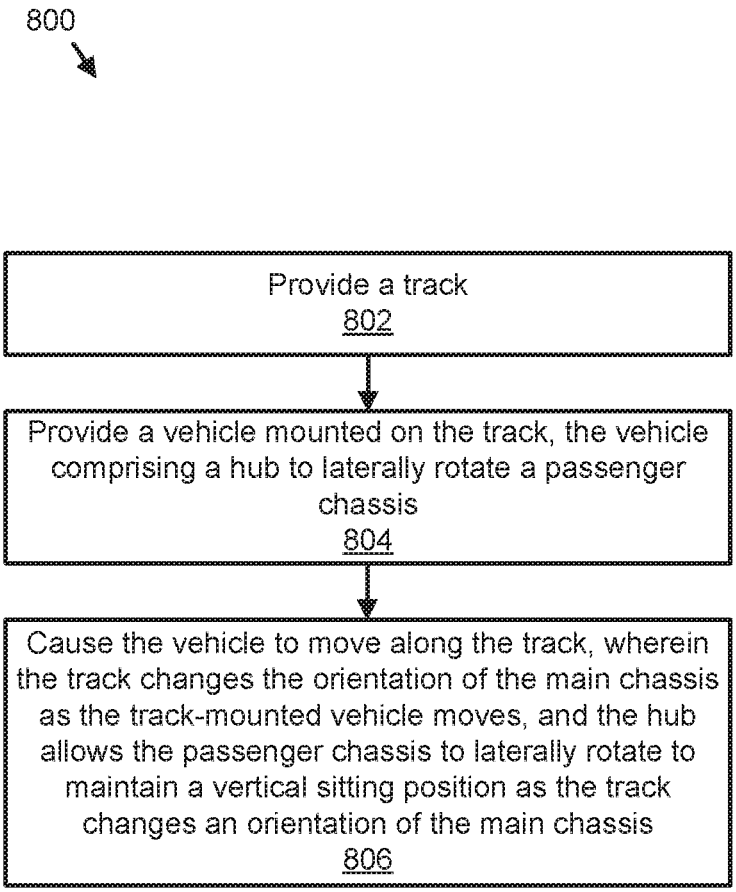
FIG. 8 illustrates a flow chart of a method for operating an amusement ride consistent with embodiments of the present disclosure.

FIG. 8 illustrates a flow chart of a method 800 for operating an amusement ride consistent with embodiments of the present disclosure. The method 800 may be performed using any of the embodiments disclosed herein by an owner or operator of an amusement ride.

The method 800 includes providing 802 a track for supporting and guiding a track-mounted vehicle and providing 804 a track-mounted vehicle. The vehicle may include a main chassis configured to ride on the track, the main chassis comprising a frame projecting away from the track, the frame having a proximal portion and a distal portion, wherein the distal portion is further from the track than the proximal portion. The vehicle may further include a passenger chassis with one or more passenger seats. A hub may rotatably couple the passenger chassis behind the passenger seats to the distal portion of the main chassis. In some embodiments, the hub allows the passenger seats to perform a full lateral rotation relative to the main chassis. The rotation may be due to centrifugal force or a change in orientation of the main chassis relative to the track. A change in the orientation of the main chassis as the track-mounted vehicle moves along the track may cause a height of the passenger chassis to change while the hub allows the passenger chassis to laterally rotate to maintain a vertical sitting position.

The method 800 also includes causing 806 the track-mounted vehicle to move along the track. When the track changes the orientation of the main chassis as the track-mounted vehicle moves, the hub allows the passenger chassis to laterally rotate to maintain a vertical sitting position as the track changes an orientation of the main chassis. In some embodiments, the method 800 may further include adjusting the hub to limit rotation of the passenger chassis relative to the main chassis. Additionally, the method 800 may include damping, via the hub, the passenger chassis relative to the main chassis.

It will be understood by those having skill in the art that changes may be made to the details of the above-described embodiments without departing from the underlying principles presented herein. For example, any suitable combination of various embodiments, or the features thereof, is contemplated.

Any methods disclosed herein comprise one or more steps or actions for performing the described method. The method steps and/or actions may be interchanged with one another. In other words, unless a specific order of steps or actions is required for proper operation of the embodiment, the order and/or use of specific steps and/or actions may be modified.

Throughout this specification, any reference to "one embodiment," "an embodiment," or "the embodiment" means that a particular feature, structure, or characteristic described in connection with that embodiment is included in at least one embodiment. Thus, the quoted phrases, or variations thereof, as recited throughout this specification, are not necessarily all referring to the same embodiment.

Similarly, it should be appreciated that in the above description of embodiments, various features are sometimes grouped together in a single embodiment, figure, or description thereof for the purpose of streamlining the disclosure. This method of disclosure, however, is not to be interpreted as reflecting an intention that any claim requires more features than those expressly recited in that claim. Rather, inventive aspects lie in a combination of fewer than all features of any single foregoing disclosed embodiment. It will be apparent to those having skill in the art that changes may be made to the details of the above-described embodiments without departing from the underlying principles set forth herein. The scope of the present invention should, therefore, be determined only by the following claims.

The invention claimed is:

1. An amusement ride vehicle comprising:

a main chassis configured to ride on a track, the main chassis comprising a frame projecting away from the track, the frame having a proximal portion and a distal portion, wherein the distal portion is further from the track than the proximal portion;

a passenger chassis with one or more passenger seats; and a hub coupling the passenger chassis to the distal portion of the main chassis at a single rotatable connection point, and wherein the passenger chassis is mounted to face forward or rearward with respect to a direction of travel of the main chassis and the hub allows the passenger chassis to perform a full lateral rotation in a direction approximately orthogonal relative to the direction of travel of the main chassis around a single axis that is approximately aligned with the direction of travel of the main chassis to maintain a vertical sitting position as the track changes an angle of the main chassis as the main chassis travels along the track, wherein the frame projecting away from the track forms a generally A-shaped structure with legs of the A-shaped structure extending to the track and a peak of the A-shaped structure forming the rotatable connection point.

2. The amusement ride vehicle of claim 1, wherein the hub dampens rotation of the passenger chassis with respect to the main chassis.

3. The amusement ride vehicle of claim 1, wherein the hub comprises:

a magnet generating a magnetic field and coupled to the main chassis; and a fin coupled to the passenger chassis such that the passenger chassis rotates with the fin, the fin extending into the magnetic field of the magnet, the fin configured to dampen rotation of the passenger chassis with respect to the main chassis.

4. The amusement ride vehicle of claim 1, wherein the hub comprises:

a magnet generating a magnetic field and coupled to the passenger chassis such that the passenger chassis rotates with the magnet; and a fin coupled to the main chassis and extending into the magnetic field of a circular magnetic array, the fin configured to dampen rotation of the passenger chassis with respect to the main chassis.

5. The amusement ride vehicle of claim 1, wherein the passenger chassis rotates via the hub to maintain a vertical sitting position as the track changes an orientation of the main chassis.

6. The amusement ride vehicle of claim 1, wherein the frame is positioned to provide an unobstructed view to passengers in the one or more passenger seats.

7. The amusement ride vehicle of claim 1, wherein an axis of the lateral rotation is positioned in the center of the one or more passenger seats.

8. A system for pivoting passenger seats on an amusement ride, the system comprising:

a track for supporting and guiding track-mounted vehicles; and a track-mounted vehicle comprising:

a main chassis configured to ride on the track, the main chassis comprising a frame projecting away from the track, the frame having a proximal portion and a distal portion, wherein the distal portion is further from the track than the proximal portion;

a passenger chassis with one or more passenger seats; and a hub rotatably coupling the passenger chassis to the distal portion of the main chassis at a single rotatable connection point, wherein the passenger chassis is mounted to face forward or rearward with respect to a direction of travel of the main chassis and the frame is entirely behind the passenger seats, and wherein the passenger chassis rotates laterally in a direction approximately orthogonal to the direction of travel of the main chassis via the hub around a single axis that is approximately aligned with the direction of travel of the main chassis to maintain a vertical sitting position as the track changes an angle of the main chassis as the main chassis travels along the track, wherein the frame projecting away from the track forms a generally A-shaped structure with legs of the A-shaped structure extending to the track and a peak of the A-shaped structure forming the rotatable connection point.

9. The system for pivoting passenger seats on an amusement ride of claim 8, wherein the hub allows the passenger chassis to perform a full lateral rotation relative to the main chassis.

10. The system for pivoting passenger seats on an amusement ride of claim 8, wherein the hub dampens rotation of the passenger chassis with respect to the main chassis.

11. The system for pivoting passenger seats on an amusement ride of claim 8, wherein the hub uses eddy currents to control spin rate of the passenger chassis.

12. The system for pivoting passenger seats on an amusement ride of claim 8, wherein the hub comprises:

a magnet generating a magnetic field and coupled to the main chassis; and a fin coupled to the passenger chassis such that the passenger chassis rotates with the fin, the fin extending into the magnetic field of the magnet, the fin configured to dampen rotation of the passenger chassis with respect to the main chassis.

13. The system for pivoting passenger seats on an amusement ride of claim 8, wherein the hub allows the passenger chassis to move laterally based on centrifugal force as the track-mounted vehicle moves along the track.

14. The system for pivoting passenger seats on an amusement ride of claim 8, wherein the frame is positioned to provide an unobstructed view to passengers in the passenger seats.

15. The system for pivoting passenger seats on an amusement ride of claim 8, wherein an axis of lateral rotation is a center of the one or more passenger seats.

16. A method for operating an amusement ride, comprising:

providing a track for supporting and guiding track-mounted vehicles;

providing a track-mounted vehicle comprising:

a main chassis configured to ride on the track, the main chassis comprising a frame projecting away from the track, the frame having a proximal portion and a distal portion, wherein the distal portion is further from the track than the proximal portion;

a passenger chassis with one or more passenger seats; and a hub rotatably coupling the passenger chassis to the distal portion of the main chassis at a single rotatable connection point, wherein the passenger chassis is mounted to face forward or rearward with respect to a direction of travel of the main chassis, and wherein the single rotatable connection point is behind the passenger seats such that the frame is entirely behind the passenger seats, wherein the hub allows the passenger seats to perform a full lateral rotation in a direction approximately orthogonal relative to the direction of travel of the main chassis around a single axis that is approximately aligned with the direction of travel of the main chassis to maintain a vertical sitting position as the track changes an angle of the main chassis as the main chassis travels along the track, wherein the frame projecting away from the track forms a generally A-shaped structure with legs of the A-shaped structure extending to the track and a peak of the A-shaped structure forming the rotatable connection point; and causing the track-mounted vehicle to move along the track, wherein the track changes an orientation of the main chassis as the track-mounted vehicle moves.

17. The method for operating an amusement ride of claim 16, further comprising adjusting the hub to limit rotation of the passenger chassis relative to the main chassis.

18. The method for operating an amusement ride of claim 16, further comprising damping, via the hub, the passenger chassis relative to the main chassis.

19. The method for operating an amusement ride of claim 16, further comprising loading passengers while the main chassis is in a first orientation relative to the track, wherein orientation of the main chassis changes as the track-mounted vehicle moves along causing a height of the passenger chassis relative to the track to change while the hub laterally rotates the passenger chassis to maintain the vertical sitting position.

20. The method for operating an amusement ride of claim 16, wherein the hub allows the passenger chassis to laterally rotate based on centrifugal force as the track-mounted vehicle moves along the track.

21. An amusement ride vehicle comprising:

a main chassis configured to ride on a track, the main chassis comprising a frame projecting away from the track, the frame having a proximal portion and a distal portion, wherein the distal portion is further from the track than the proximal portion;

a passenger chassis with one or more passenger seats; and a hub coupling the passenger chassis to the distal portion of the main chassis behind the passenger chassis such that the frame is entirely behind the passenger one or more seats, wherein the passenger chassis is mounted to face forward or rearward with respect to a direction of travel of the main chassis and wherein the hub allows the passenger chassis to perform a full lateral rotation in a direction approximately orthogonal relative to the direction of travel of the main chassis around a single axis that is approximately aligned with the direction of travel of the main chassis to maintain a vertical position as the track changes an angle of the main chassis as the main chassis travels along the track, wherein the frame projecting away from the track forms a generally A-shaped structure with legs of the A-shaped structure extending to the track and a peak of the A-shaped structure forming a rotatable connection point at the hub.

22. The amusement ride vehicle of claim 21, wherein the hub dampens rotation of the passenger chassis with respect to the main chassis.

23. The amusement ride vehicle of claim 22, wherein the hub dampens the rotation at a variable rate dependent on a rotational position of the one or more passenger seats.

24. The amusement ride vehicle of claim 21, wherein the hub comprises:

a magnet generating a magnetic field and coupled to the main chassis; and a fin coupled to the passenger chassis such that the passenger chassis rotates with the fin, the fin extending into the magnetic field of the magnet, the fin configured to dampen rotation of the passenger chassis with respect to the main chassis.

25. The amusement ride vehicle of claim 21, wherein the hub comprises:

a magnet generating a magnetic field and coupled to the passenger chassis such that the passenger chassis rotates with the magnet; and a fin coupled to the main chassis and extending into the magnetic field of a circular magnetic array, the fin configured to dampen rotation of the passenger chassis with respect to the main chassis.

26. The amusement ride vehicle of claim 21, wherein the passenger chassis rotates via the hub to maintain a vertical sitting position as the track changes an orientation of the main chassis.

27. The amusement ride vehicle of claim 21, wherein the frame is positioned to provide an unobstructed view to passengers in the one or more passenger seats.

28. The amusement ride vehicle of claim 21, wherein an axis of the lateral rotation is positioned in the center of the one or more passenger seats.

* * * * *